US005299367A

United States Patent [19]

Johnson et al.

[11] Patent Number: 5,299,367

[45] Date of Patent: Apr. 5, 1994

[54] HAIR DRYING CURLER APPARATUS

[76] Inventors: Lonnie G. Johnson, 4030 Ridgehurst Dr., Smyrna, Ga. 30080; Francis LeVert, 1725 Magnolia Ave., Knoxville, Tenn. 37917

[21] Appl. No.: 957,675

[22] Filed: Oct. 7, 1992

[51] Int. Cl.[5] ..... F26B 13/26

[52] U.S. Cl. ..... 34/95; 132/221; 132/252; 34/96

[58] Field of Search ..... 34/3, 9, 69, 71, 95, 34/95.1, 96, 103, 80, DIG. 1, 95.3; 132/252, 251, 221, 245, 220, 226, 227

[56] References Cited

U.S. PATENT DOCUMENTS

| | | | |
|---|---|---|---|
| 2,646,053 | 7/1953 | Harris | 34/96 |
| 2,919,494 | 1/1960 | Runci | 34/96 |
| 3,109,437 | 11/1963 | Broyles | 34/96 |
| 3,175,562 | 3/1965 | Reed | 34/96 |
| 3,415,255 | 12/1968 | Mitsumoto | 132/221 |
| 3,656,490 | 4/1972 | Grossman | 132/221 |
| 3,888,266 | 6/1975 | Weldon et al. | 132/221 |
| 4,041,961 | 8/1977 | Shaler et al. | 132/221 |

FOREIGN PATENT DOCUMENTS

| | | | |
|---|---|---|---|
| 907426 | 3/1946 | France | 132/222 |

*Primary Examiner*—Henry A. Bennet
*Assistant Examiner*—Denise L. Gromada
*Attorney, Agent, or Firm*—Hopkins & Thomas

[57] ABSTRACT

A hair drying curler apparatus comprises a curler body and a curler clip, whereby the curler clip is adapted to snap in place over the curler body with a damp lock of the user's hair captured therebetween. The curler body is formed such that a material having a high-surface area extends about and is bonded to an outer surface of the curler body so as to allow an ample amount of hair drying expediting material to be evenly dispersed therethrough. The curler clip is configured in a similar manner as the curler body, whereby the inner surface of the clip is lined with a material having a high-surface area for hair drying expediting material to be embedded therethrough. Additionally, the curler clip is configured so as to clip a lock of hair on the curler body, and so as to expedite the drying of the damp hair between adjacent curlers. Therefore, when the present apparatus is applied to damp hair, the hair is dried and curled simultaneously.

20 Claims, 2 Drawing Sheets

HAIR DRYING CURLER APPARATUS

FIELD OF THE INVENTION

The present invention relates in general to an apparatus for use with drying locks of hair and curling the hair simultaneously. More particularly, the invention relates to a hair roller and its clip, both of which are adapted to capture a lock of hair and function to dry the hair so that the hair is curled and set simultaneously.

BACKGROUND OF THE INVENTION

The setting of human and artificial hair by drying, waving, and curling is a subject which has received considerable attention for several centuries. Presently, a variety of devices and methods are available on the market for curling or setting hair permanently or temporarily. For instance, a "permanent" wave or a "perm" is obtained by chemically treating and drying locks of hair while rolled in rollers or bobbins. Such permanent waves usually last from approximately several months to one year. However, for people who desire a more temporary hairstyle or setting, a multitude of devices also are currently available. Such devices include hot rollers, steam rollers, overnight hair rollers, and curling irons and are fabricated in a wide variety of shapes, sizes and materials for both professional and in-the-home hair treatment.

Since the advent of such temporary hair setting devices, means have been sought for accelerating the drying of wet hair on the rollers to obtain a curl having soft and natural characteristics. In a professional salon, the acceleration of roller-supported hair is usually accomplished by a hair dryer in the form of an air circulating bonnet which forces heated air over the rolled hair. The person receiving the hair treatment in a professional hair salon is usually seated under such a dryer until the desired degree of dryness is achieved. While functioning well to dry the hair, forced air hair dryers such as that just discussed are known to be undesirably confining and uncomfortable for the user since the bonnet immobilizes its user for a considerable length of time. In a home environment, a portable hair dryer is most commonly used for accelerating the drying of hair. However, the home-use hair dryer also confines a person to a limited area of movement due to the connection of the dryer to an electrical outlet for the power supply. Hence, conventional devices for drying hair often are known to be uncomfortable, immobilizing, and time consuming.

Hair drying roller apparatuses have previously been proposed as a means for drying hair simultaneously with other treatments such as curling, waving, body building, and the like. One example of such a proposed hair drying roller apparatus is disclosed in U.S. Pat. No. 3,415,255 of Mitsumoto. Mitsumoto shows a hygroscopic hair curler, which comprises a curler body and a U-shaped elongated clip to retain the rolled-up wet locks of hair on the curler body. The curler is a cylindrical, spool-shaped body including a layer of hygroscopic powder, dispersed on an interior portion of the roller. A fibrous material, which covers the hygroscopic powder serves as a transmission medium for allowing moisture from the hair to permeate to the hygroscopic powder layer.

Hygroscopic materials include materials such as silica gel, calcium chloride, kaolin, and the like. During a curling operation, moist locks of hair are rolled onto the cylindrical curlers and clipped by the U-shaped clip device whereupon moisture in the hair is absorbed by the hygroscopic powder of the curler to dry the wet locks of hair. Thus, when the hair is released from the curler by unfastening the clip, the locks of hair will retain their new rolled form until the hair is moistened or washed again.

Another apparatus for drying and curling hair simultaneously is disclosed in U.S. Pat. No. 3,656,490 of Grossman, wherein a plurality of pellets, which comprise a hair drying expediting material, are enclosed within a cylindrical porous roller. Such pellets are held therein by two opposite and opposed end caps which fit snugly into the ends of the cylindrical roller. The pellets are comprised of a clay material mixed with an absorbent natural silicate and a binder that holds the clay and the silica together. In use, the pellets are inserted into the hair roller and held therein by the end caps. Damp locks of wet hair are wound about the outer periphery of the roller and held thereon by generic clips or hair pins. As moisture is drawn out of the hair through the porous roller, the pellets dampen, thereby causing the pellets to emit heat. After the hair has been dried and curled, the pellets are removed from the hair roller and are allowed to dry, either by exposing them to heat or by drying at room temperature until the next hair setting treatment.

A similar apparatus is disclosed in U.S. Pat. No. 4,041,961 of Shaler et al.. wherein the hair roller itself comprises a sintered desiccant body of a hollow cylindrical configuration. The roller further includes a heat storage core of cylindrical shape and a material which covers the body of the desiccant roller. The heat storage core further defines a bore adapted therethrough which is able to receive a heating element or a pin for imparting heat into the core. The desiccant roller body of Shaler et al. is a self-sustaining hollow cylinder comprising a mass of desiccant granules, such as silica gel, which are held together by particles of binder, such as nylon. Furthermore, each granule is of irregular shape and is assembled to form the desired overall hollow cylindrical shape by means of a retaining form or mold. The Shaler et al. roller is used in a similar manner as the rollers of Mitsumoto and Grossman.

While these and other similar apparatuses have been somewhat successful in drying and curling hair simultaneously, they still tend to exhibit certain problems and shortcomings inherent in their respective designs. For instance, several of these apparatuses are used in conjunction with a generic pin or clip for holding the hair on the rollers. Such designs are shown in the patents of Mitsumoto and Grossman. With such a configuration, it is difficult to ensure uniform heat transfer from the desiccant in the hair rollers to certain portions of the hair. For example, when hair is wound about a roller from the ends of the hair to the roots of the hair, the hair ends adjacent the roller tend to dry and curl more rapidly than the portions of hair near its roots. Therefore, when the rollers are removed, there is a chance that the hair in the closest proximity to the roller will dry and form a natural curl shape and the hair furthest away from the roller, such as at its roots, will remain slightly damp and uncurled.

The device disclosed in the patent of Shaler et al. attempts to solve the above-discussed problem by providing an arcuate-shaped or C-shaped clamp for disposal over a lock of hair on the roller. The arc-shaped clamp further includes a sintered desiccant body therein for aiding in the drying of the exposed portions of hair. However, hard-to-curl portions of hair, such as hair between adjacent rollers on hair near the scalp might not contact either the roller or the arc-shaped clamp. Therefore, a chance exists that these hard-to-curl portions will still remain damp after the rollers are removed from the hair, thereby causing an uneven, unnatural curl setting.

Accordingly, there exists a continuing need for a hair drying roller apparatus for use in a professional salon or at home, with the apparatus being simple to use, inexpensive to produce, and is capable of fully drying and evenly curling all portions of the hair. It is to the provision of such a hair drying roller apparatus that the present invention is primarily directed.

SUMMARY OF THE INVENTION

Briefly described, the present invention comprises a hair drying curler apparatus for home use or use in a professional salon that ensures the uniform drying of curled locks of hair, including in hard-to-dry areas such as portions of hair closest to the roots of the hair or scalp of the head or hair disposed between adjacent rollers. In a preferred embodiment, the hair drying curler apparatus comprises a cylindrical curler body and an omega-shaped clip, which is adapted to snap in place over the roller with a lock of the user's hair captured between the outer surface of the roller and the inner surface of the clip. Both the curler and the clip are formed partially of a desiccant adapted to absorb water and, through chemical reactions resulting from the absorption, generate heat. A partial exemplary list of desiccants includes silica gal, activated alumina, activated charcoal, and the like.

The curler comprises a hollow inner core having several substrate layers. Extending about and bonded to the core is an intermediate layer formed of a high-surface area material, such as Velcro TM, whereby an ample amount of hair drying expediting material, such as a desiccant, can be evenly embedded therethrough. The desiccant can be mounted to the Velcro material by a thin coat of spray adhesive, and can be held in place about the exterior of the curler by means of a thin, absorptive sheet of material extending tightly thereabout. The absorptive sheet of material allows water to permeate from the damp lock of hair to the desiccant, which emits heat as it absorbs the water.

The omega-shaped clip comprises a springy, plastic outer shell having an insulative lining on the interior surface thereof. A moisture impermeable sheet of material is bonded to the insulative lining and a layer of desiccant, such as silica gel, is mounted thereon by means of an adhesive spray. The moisture impermeable sheet of material can comprise a sheet of high-surface area material, such as a loop portion in a Velcro loop and hook fastener for disbursing the desiccant in an even fashion thereon. Similar to the roller construction, an absorptive sheet of material extends tightly about the desiccant layer and is adjacent the lock of wet hair when the apparatus is in use.

The loop portion of a loop and hook material used in the construction of the hair curler and clip of the present invention provides the advantage of increasing the amount of surface area in which the desiccant can become impregnated, thereby increasing the effectiveness of the amount of desiccant used. This construction enables an increase in the amount of desiccant granules contained within the curler and the clip without a layering effect, which normally reduces the effectiveness of the desiccant granules embedded beneath the layer of desiccant granules adjacent the wet hair. Additionally, the loop fiber lengths can be used to increase or decrease the desiccant mass per roller so as to provide a means for tailoring the amount of desiccant necessary for fully drying and evenly curling different lengths and types of hair. Therefore, the curler body and clip of the present invention more efficient in utilization of the desiccant granules and also more effective in fully drying and forming an even curl.

In use, a user's hair is typically washed in preparation for drying and rolling. A selected lock of wet hair is then positioned over and rolled about the roller and the clip is snapped over the roller and the hair such that the lock of hair is pressed tightly and in an arcuate configuration between the outer surface of the roller and the inner surface of the clip. The lock of hair, therefore, is sandwiched between opposing surfaces of the moisture absorbent material of the roller body and the clip, which draws the moisture into contact with the desiccant. When moisture from the hair contacts the desiccant, the desiccant begins to absorb moisture from the hair. As the chemical absorption of moisture from the hair occurs, heat is emitted from the desiccant, which heats the lock of hair and speeds the drying process. In a short period of time, the lock of hair is dry and when the clip is removed from the curler to release the lock of hair, the hair is dry and set in a curled shape.

Naturally, use of a plurality of the rollers and clips of the present invention would be necessary to curl a typical user's head of hair. Under these circumstances, the silica gel on the lower surface of the omega-shaped legs of the clip rests against the user's hair between adjacent curlers such that this hair is dried along with the hair that is captured between the rollers and the clip. The configuration of the clip allows for drying the hair in areas which are typically harder to dry, such as at the roots of the hair, near the scalp of the head, and hair between curlers. As a result, a full head of hair can be completely dried, evenly curled, and set simultaneously without immobilizing the user and without the hassle of using several different devices and a great deal of time to achieve a curled set.

In another embodiment, a flat flexible band of material is lined with a similar configuration as the above-described embodiment implementing the use of a hair drying expediting material, such as a desiccant, which is covered with a liner of absorptive material extending thereabout. A lock of wet hair can simply be wound up in a spiral fashion on the flat flexible sheet so that the hair can be dried and curled to form spiral curls.

The hair drying curlers of the present invention can be regenerated by a simple heat regeneration of the hair drying expediting material after each use thereof. For example, the rollers and omega-shaped clips can be regenerated by placing the rollers in a microwave oven or a hot air container at a temperature of approximately 200° F. for a period of time. The time necessary for regenerating the apparatus is dependent upon the amount of absorbed moisture in the desiccant and the humidity of the ambient air.

Thus, it is seen that an improved hair drying curler apparatus is now provided for drying and curling locks of hair quickly, reliably, and conveniently. The curling apparatus is efficiently designed so that all portions of the hair can be evenly dried and curled without the hassle of being confined to a limited area of movement, as is quickly experienced by users of conventional mechanical hair dryers. Thus, the present invention is time efficient, whereby the two separate steps of drying and curling the hair are combined into a simple one-step process. Additionally, the present invention increases the efficiency of the hair drying expediting material or desiccant within the hair drying curler apparatus by embedding the desiccant in a high-surface area material, which is, consequently, more economical and efficient for the user.

A more complete understanding of the present invention will be had by those skilled in the art, as well as an appreciation of additional advantages, which will become apparent upon reading the detailed description of the preferred embodiment and examining the drawings, the following being a brief description thereof.

DETAILED DESCRIPTION OF THE PREFERRED EMBODIMENT

Figure 1:
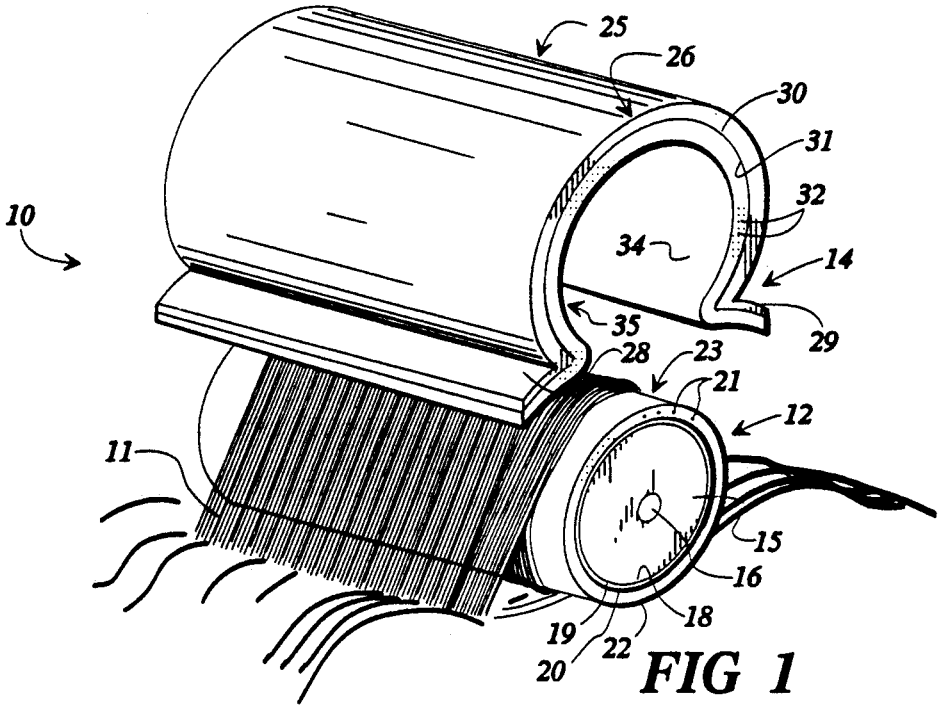
FIG. 1 is a partially exploded perspective view of the hair drying curler apparatus that embodies principles of the present invention in one preferred form.

Referring now in more detail to the drawings, in which like numerals refer to like parts throughout the several views, FIG. 1 illustrates a hair drying curler assembly 10 that embodies principles of the invention in one preferred form. The assembly 10 is shown partially exploded to reveal clearly the elements of the assembly on a lock of hair 11. The hair drying curler assembly 10 comprises a cylindrically-shaped curler body 12 and an arcuate, omega-shaped curler clip 14 adapted to snap in place over the curler body 12 with a lock of the user's hair 11 captured therebetween.

Figure 3:
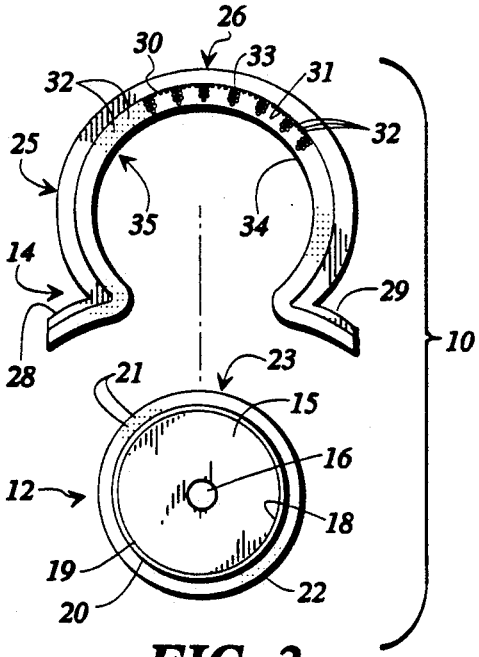
FIG. 3 is a partially exploded end view of the hair drying curler apparatus of FIG. 1.

As best illustrated in FIGS. 1 and 3, the curler body 12 comprises a cylindrical core 15 with a bore hole 16 formed therethrough. The core 15 comprises a foam or a similar material and has an outer surface 18. Extending about and bonded to the outer surface 18 of the core 15 is a layered substrate having an inner layer 19 formed of an insulating material so as to prevent heat transfer therethrough. An intermediate layer of material 20 extends about and is bonded to the inner insulative material 19, and comprises a sheet of high-surface area material. Materials of such nature include materials having tiny loops thereon, such as the loop portion of a loop and hook Velcro material. In the present invention, the high-surface area material 20 provides enough surface area for ample amounts of hair drying expediting material 21 to be embedded throughout the material 20. The hair drying expediting material 21 can be held in place about the exterior of the curler body 12 by means of both an adhesive spray and by a thin, absorptive cover 22, which extends tightly thereabout and forms an exterior surface 23 of the curler body 12.

Figure 2:
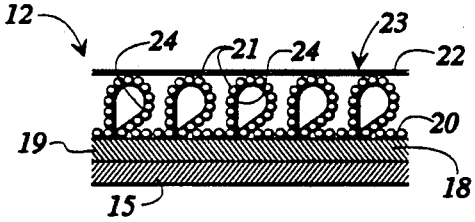
FIG. 2 is an exploded cross-sectional view of the curler of FIG. 1 showing a preferred configuration of the hair drying expediting material.

The curler body 12 and its configuration, as seen in FIG. 2, is discussed in detail hereinbelow. In general, the intermediate layer 20 is shown formed of a loop material having a multitude of tiny loops 24, similar to the loop portion of a loop and hook Velcro fastener. The surface area for impregnating a hair drying expediting material or desiccant 21 is thereby increased by the tiny loops 24. This configuration yields the advantage of increasing the amount of desiccant 21 that can be dispersed within the curler body 12, while simultaneously avoiding a layering of the desiccant granules. Normally, desiccant granules embedded several layers beneath the top layer of desiccant granules 21 which are closest to the absorptive cover 22, are less effective in the amount of moisture absorbed.

The omega-shaped curler clip 14 comprises a springy outer shell 25 having an arcuate-shaped body 26 and two legs 28 and 29 as best seen in FIGS. 1 and 3. Additionally, an interior portion 30 of the outer shell 25 of the clip 14 can include an insulative lining (not shown). Extending along and bonded to the insulative lining of the clip 14 is an intermediate sheet of material 31, having a high-surface area material 33 for embedding ample amounts of desiccant granules 32 thereon. As shown in FIG. 3, the high surface area material 33 can comprise a material having a plurality of spaced projections for deposition the desiccant granules 32 thereon. In addition, the material 31 can comprise the loop portion of a loop and hook fastener material, such as the loop portion of Velcro, and the desiccant granules 32 can be impregnated thereon by means of a spray adhesive in the same manner as shown in FIG. 2.

Figure 4:
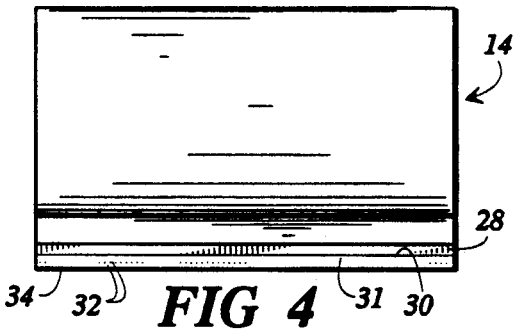
FIG. 4 is a side elevational view of the clip of the embodiment of FIG. 1.
Figure 5:
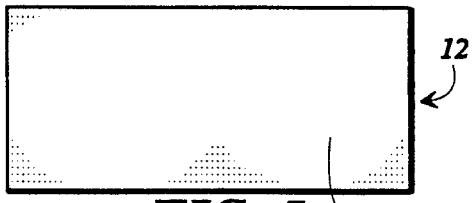
FIG. 5 is a side elevational view of the roller of FIG. 1.

Additionally, a thin, water permeable cover material 34 extends tightly about the layer of desiccant 32 so as to hold the desiccant in place about the intermediate sheet of material 31. The cover material 34, thus forms an interior surface 35 of the curler clip 14. Consequently, shown in FIG. 4, the omega-shaped curler 14 provides the advantage of including a desiccant 32 impregnated, high-surface area material 31 in the leg portions 28 and 29 (not shown) for drying the hair in hard-to-dry areas, such as between adjacent rollers as described in more detail below.

When using the present invention for drying and curling hair, a user's hair is typically washed in preparation for the hair treatment. A selected lock of hair 11 (FIG. 1) can then be positioned over the curler body 12 and coiled about the curler body 12 until the curler body is adjacent the scalp of a user's head. The curler clip 14 is snapped over the curler body 12 and the hair 11 such that the lock of hair 11 is pressed tightly and in an arcuate configuration between the exterior surface 23 of the curler body 12 and the interior surface 35 of the curler clip 14.

The desiccant granules of the curler body 12 and curler clip 14 form opposing surfaces of the lock of hair 11 and begin to absorb moisture from the hair through the water permeable cover 22 of the curler body and through the moisture absorptive layer 34 of the curler clip 14. Thus, the hair is dried expediently as a result of the moisture absorptive characteristic of the desiccant. Further, when the chemical absorption of the moisture occurs, heat is created in the desiccant, which heats the lock of hair and speeds the drying process. In several minutes, the lock of hair is dry such that its arcuate shape or curl is set firmly in place. Thus, the clip 14 can then be removed from the curler body 12 so as to release the curled lock of hair 11.

Naturally a plurality of rollers and clips of the present invention would be necessary in curling a typical user's head of hair. Under the circumstances, the desiccant on the lower surface of the legs 28 and 29 of the curler clip 14, rests against the user's hair between adjacent curlers. Thus, the hair between adjacent curlers is dried along with the hair that is captured between the curler and the clip.

Figure 6:
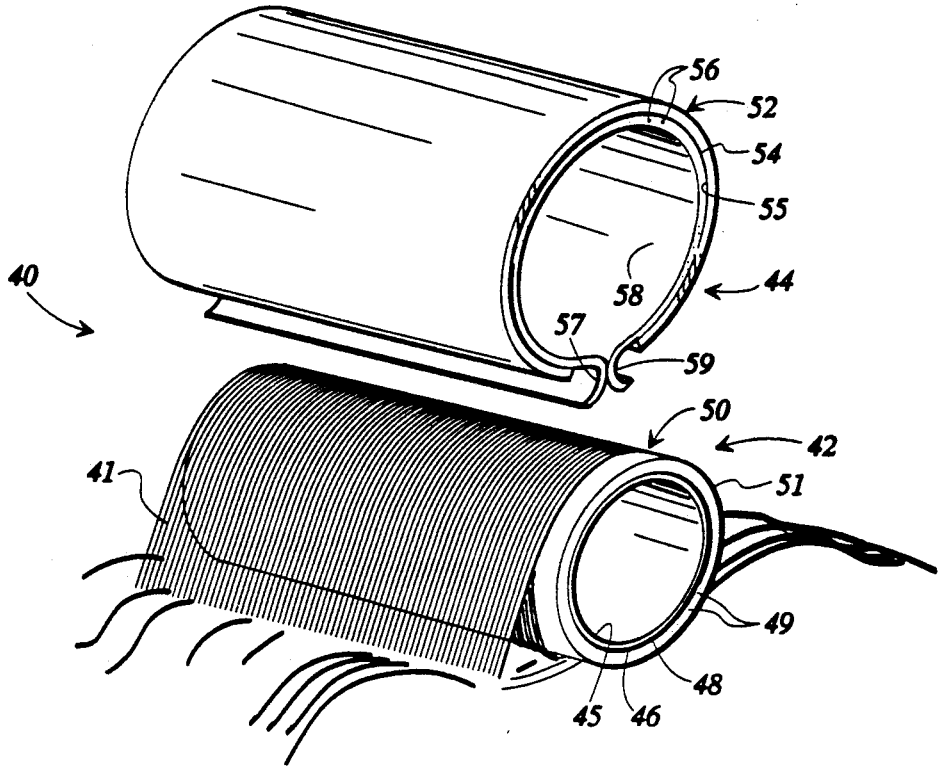
FIG. 6 is a partially exploded perspective view of an alternate embodiment of the hair drying curler apparatus that embodies principles of the present invention.
Figure 7:
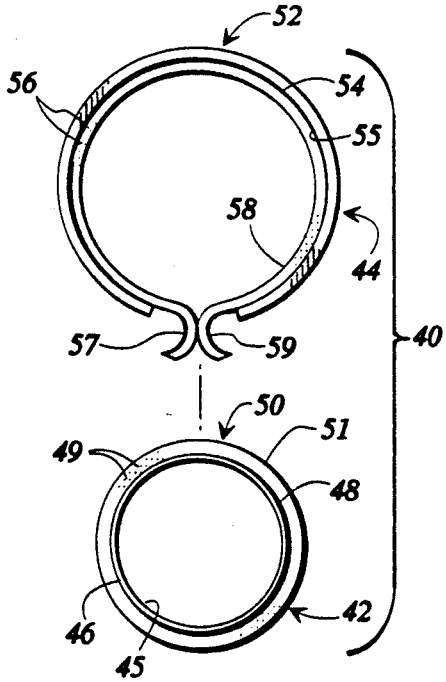
FIG. 7 is a partially exploded end view of the hair drying curler apparatus of FIG. 6.

FIGS. 6 and 7 illustrate an alternate embodiment 40 of the present invention. This embodiment 40 is also configured for use in simultaneously drying and curling a lock of hair 41. The hair drying curler assembly of this embodiment 40 comprises a hollow, cylindrically-shaped curler body 42 and an arcuate, C-shaped curler clip 44 adapted to snap in place over the curler body 42 with a lock of the user's hair 11 captured therebetween. As seen in FIGS. 6 and 7, the curler body 42 comprises a generally rigid hollow core 45 having an outer surface 46. The curler body 42 is formed of plastics or similar materials. Extending about and bonded to the outer surface 46 of the core 45 is an intermediate layer of high-surface area material 48 having hair drying expediting materials 49 impregnated therethrough. Similar to the first embodiment, materials having high-surface area, include materials such as the loop portion of a loop and hook Velcro material. Likewise, the high-surface area material 48 provides enough surface area for ample amounts of hair drying expediting material 49, such as desiccant, to be embedded throughout the material 48. The hair drying expediting material 49 can be held in place about an exterior portion 50 of the curler body 42 by means of both an adhesive spray (not shown) and by a thin, absorptive cover 51 which extends tightly thereabout.

The C-shaped curler clip 44 comprises a springy outer shell 52, having a C-shaped body. Additionally, an interior portion 54 of the outer shell 52 can include an insulative lining (not shown). Extending along and bonded to the interior portion 54 of the outer shell 52 is an intermediate sheet of material 55, having a high-surface area for embedding ample amounts of desiccant granules 56 therethrough. The intermediate sheet of material 55 can comprise the loop portion of a loop and hook fastener material, such as the loop portion of Velcro. Similar to the embodiment discussed in FIGS. 1 through 5, the desiccant granules 56 can be impregnated therethrough by means of a spray adhesive and take the same configuration as shown in FIG. 2. Additionally, a thin, water permeable cover material 58 extends tightly about the layer of desiccant 56 so as to hold the desiccant in place about the intermediate sheet of loop material 55.

In this embodiment 40, the intermediate sheet of material 55 of the curler clip 44 extends beyond the edges of the springy C-shaped curler clip shell 52, forming two flexible flaps 57 and 59. The two flaps 57 and 59 are impregnated with the desiccant 56 and covered by the cover 58, along with the rest of the high-surface area material. Thus, the hairs between the adjacent curles are dried by the flexible flaps laying over the hair.

Figure 8:
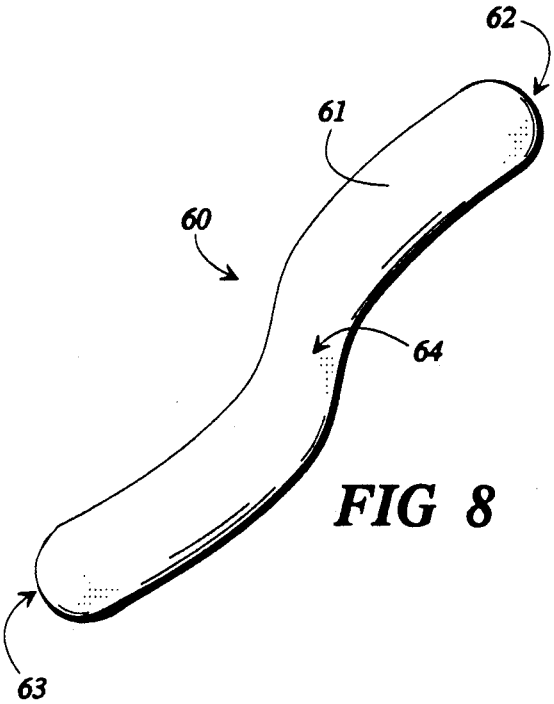
FIG. 8 is a perspective view of another embodiment of the hair drying curler apparatus.

As illustrated in FIG. 8, another embodiment 60 comprises a flat, flexible band of material 61 having end portions 62 and 63, wherein the flexible band 61 is lined with a layer of high surface area material (not shown) having hair drying expediting material (not shown) bonded thereon. A moisture permeable cover 64 contains the high surface area material and expediting material in the band 61 and extends therearound. Thus, a lock of wet hair can simply be wound up in a spiral fashion on a flat, flexible band 61 and the end portions 62 and 63 can be twisted together so as to hold and maintain the lock of hair on the band 61 for drying and for forming spiral shaped curls.

The invention has been disclosed and described herein in terms of preferred configurations and methodologies. However, it will be obvious to those of skill in the art that numerous variations of the illustrated embodiments could be implemented within the scope of the invention. For example, the present invention could be formed into a curling iron or any other curling apparatus. Further, a wide variety of hair drying expediting material or desiccants can be implemented to perform the same functions of the present invention in an acceptable manner.

These and other additions, deletions, and modifications might well be made to the exemplary embodiments illustrated herein without departing from the spirit and the scope of the invention as set forth in the claims.

I claim:

1. A hair drying curler apparatus for use in the treatment of drying and curling locks of damp hair, said apparatus comprising:

a curler body having a shape and configuration onto which a lock of damp hair can be coiled;

a layer of high-surface area material extending about said curler body;

hair drying expediting material bonded to the surface of said high-surface area material for absorbing moisture from the hair; and a water permeable cover enveloped about said hair drying expediting material for allowing moisture from the hair to contact said hair drying expediting material;

whereby when the lock of hair is coiled about the curler apparatus, the hair drying material dries the hair in the general shape and configuration of the curler body.

2. The hair drying curler apparatus of claim 1 and further including a layer of insulative material bonded to said curler body for preventing heat transfer therethrough.

3. The hair drying curler apparatus of claim 1 and wherein said curler body is generally cylindrically-shaped.

4. The hair drying curler apparatus of claim 1 and wherein said curler body is generally a flat, flexible band.

5. The hair drying curler apparatus of claim 1 and further including a curler clip adapted to be releasably clasped about said curler body, said curler clip comprising an arcuate-shaped body having a first and a second surface, a layer of spaced projections bonded to the first surface of the arcuate-shaped body, hair drying expediting material bonded to said spaced projections for absorbing moisture from the hair, and a water permeable cover enveloped about said hair drying expediting material for allowing moisture from the hair to contact said hair drying expediting material.

6. The hair drying curler apparatus of claim 5 and wherein said arcuate-shaped clip body is generally omega-shaped in cross-section.

7. The hair drying curler apparatus of claim 5 and further including an insulative layer of material bonded to said clip body for preventing heat transfers therethrough.

8. A hair drying curler apparatus for use in the treatment of drying and curling locks of damp hair, said apparatus comprising:

a curler body onto which a lock of damp hair can be coiled;

a layer of high-surface area material extending about said curler body, said high-surface area material being formed of a loop portion of a loop and hook fastener material;

hair drying expediting material bonded to the surface of said high-surface area material for absorbing moisture form the hair; and a water permeable cover enveloped about said hair drying expediting material for allowing moisture from the hair to contact said hair drying expediting material;

whereby when the lock of hair is coiled about the curler apparatus, the hair drying material dries the hair in the general shape and configuration of the curler body.

9. The hair drying curler apparatus of claim 1 and wherein said hair drying expediting material is selected form the group consisting of: desiccants, including silica gel, activated alumina, and activated charcoal.

10. The hair drying curler apparatus of claim 1 and wherein said hair drying expediting material is mounted on said high-surface area material by a spray adhesive.

11. The hair drying curler apparatus of claim 5 and wherein said hair drying expediting material is mounted on said spaced projections.

12. A hair drying curler apparatus for use in the treatment of drying and curling locks of damp hair, said apparatus comprising:

a curler body having a shape and configuration onto which a lock of damp hair can be coiled;

a layer of spaced projections extending about said curler body;

hair drying expediting material bonded to the surface of said spaced projections, and distributed about said projections in a loose arrangement for absorbing moisture from the hair; and a water permeable cover enveloped about said hair drying expediting material for allowing moisture from the hair to contact said hair drying expediting material;

whereby when the lock of hair is coiled about the curler apparatus, the hair drying material dries the hair in the general shape and configuration of the curler body.

13. The hair drying curler apparatus of claim 12 and wherein the majority of said hair drying expediting material is directly exposed to moisture on the lock of hair so that the hair is expediently dried by the hair drying material.

14. The hair drying curler apparatus of claim 12 and wherein said curler body is generally cylindrically-shaped.

15. The hair drying curler apparatus of claim 12 and wherein said curler body is generally a flat, flexible band.

16. The hair drying curler apparatus of claim 12 and wherein said hair drying expediting material is selected form the group consisting of: desiccants, including silica gel, activated alumina, and activated charcoal.

17. The hair drying curler apparatus of claim 12 and wherein said hair drying expediting material is mounted on said high-surface area material by a spray adhesive.

18. The hair drying curler apparatus of claim 12 and further including a curler clip adapted to be releasably clasped about said curler body, said curler clip comprising an arcuate-shaped body having a first and a second surface, a layer of spaced projections bonded to the first surface of the arcuate-shaped body, hair drying expediting material bonded to said spaced projections for absorbing moisture from the hair, and a water permeable cover enveloped about said hair drying expediting material for allowing moisture form the hair to contact said hair drying expediting material.

19. The hair drying curler apparatus of claim 18 and wherein said arcuate-shaped clip body is generally omega-shaped in cross-section.

20. The hair drying curler apparatus of claim 18 and wherein said hair drying expediting material is mounted on said spaced projections by a spray adhesive means.

* * * * *